US006350026B1

(12) United States Patent
Lin

(10) Patent No.: US 6,350,026 B1
(45) Date of Patent: Feb. 26, 2002

(54) INK CARTRIDGE

(76) Inventor: Chao-ming Lin, No. 35 Tun-Huang Rd., San Ming Ward, Kaohslung (TW)

( * ) Notice: Subject to any disclaimer, the term of this patent is extended or adjusted under 35 U.S.C. 154(b) by 0 days.

(21) Appl. No.: 09/702,658

(22) Filed: Nov. 1, 2000

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,500,666 A * 3/1996 Hattori et al. ..... 347/87
6,250,750 B1 * 6/2001 Miyazawa et al. ..... 347/87

* cited by examiner

*Primary Examiner*—Anh T. N. Vo
(74) *Attorney, Agent, or Firm*—Dougherty & Troxell

(57) ABSTRACT

An ink cartridge including a case having an ink absorbent received therein and an ink-dispensing outlet provided at a bottom thereof, and a cover closing the case is provided. The cover is provided with at least an ink-filling hole, a vent hole vertically extending down into the case, and a capped ink-refilling hole. The cover is also provided at a bottom surface with a plurality of spaced transverse pressing ribs which alternately extend from two longer sides of the cover to end at points a distance exceeded a longitudinal centerline of the cover, such that a wound air path is defined below the cover by the pressing ribs for air entering into the case via the vent hole to evenly and smoothly flow throughout the case via the wound air path above the ink absorbent to ensure even and smooth supply of ink to the ink-dispensing outlet. And, a stop disc is mounted around a lower portion of the vent hole below the cover to prevent vaporized ink from entering into and thereby clogging the vent hole.

1 Claim, 6 Drawing Sheets

INK CARTRIDGE

BACKGROUND OF THE INVENTION

The present invention relates to an ink cartridge, and more particularly to an ink cartridge that has specially designed internal air path and ink-refilling hole, enabling the ink cartridge to be more easily produced at reduced bad yield and have extended usable life.

As it is known ink-jet type printers and laser type printers are now two most popular types of printers available in the computer markets. The ink-jet type printers might have an output speed slower than that of the laser type printers, but the former is far less expensive than the latter. As a matter of fact, an ink-jet printer is sufficient to provide very high printing quality for general documents and is much better than the conventional dot-matrix type printers. For these reasons, the ink-jet printers have become widely accepted computer peripheral equipment. With the popularization of ink-jet printers, there is a largely increased consumption of ink cartridges, which form a very important part of the ink-jet printers. Therefore, more and more efforts are made in an attempt to improve the structure and reduce the manufacturing cost of the ink cartridges.

According to an ink cartridge of prior art, the ink cartridge includes a case, a cover, and an ink absorbent made of foamed material. The foamed ink absorbent is disposed in the case that is then closed with the cover and a joint of the case and the cover is sealed. The cover is provided at a bottom surface with a plurality of longitudinal and transverse ribs for pressing against and therefore locating the foamed ink absorbent in the case. A space is left between the bottom surface of the cover and the ink absorbent to prevent a vent hole provided on the cover from being blocked. A blocked vent hole will cause difficulty in good dispensing of ink by the ink cartridge.

The following are some disadvantages of the ink cartridge of the prior art:

1. Both the case and the cover of the ink cartridge are made of a soft resin material. To prevent a finished product of the ink cartridge from deformation, the case is additionally provided with reinforcing ribs along its periphery. Such reinforcing ribs make the mold for forming the ink cartridge more complicate while they are not necessarily effective in solving the problem of a deformed ink cartridge. Such reinforcing ribs also have adverse influence on the appearance of the ink cartridge.
2. Most of the currently available ink cartridges are of disposable type and could not be refilled with ink. That is, once the ink in the case is used up, the whole ink cartridge must be discarded and replaced with a new one. Such disposable ink cartridges are an additional cost to consumers, and form not only an unnecessary waste of reusable resources but also a source of environmental pollution.
3. The cover is provided at its surface with a zigzag venting slot. The zigzag venting slot tends to be clogged by foreign matters during subsequent machining of the ink cartridge. And, since the zigzag venting slot is very narrow, it is easily completely blocked when the cover is still in a molten state.

It is therefore tried by the inventor to develop an improved ink cartridge that can be easily manufactured with reduced bad yield and is environmentally friendly, and therefore eliminates the drawbacks existing in the conventional disposable ink cartridges.

SUMMARY OF THE INVENTION

A primary object of the present invention is to provide an ink cartridge having specially designed vent hole and air path that enable easy production of the ink cartridges at reduced bad yield.

Another object of the present invention is to provide an ink cartridge that does not easily deform after being injection molded and is refillable with ink and can therefore have an extended usable life to reduce environmental pollution possible caused by discarded ink cartridges.

To achieve the above and other objects, the ink cartridge according to the present invention mainly includes a cover, a case, and an ink absorbent disposed in the case. The cover is provided with at least an ink-filling hole and a vent hole. No zigzag venting slot is provided on the cover. The vent hole extends downward into the case to form a solid and sealed stub below the cover. A stop disc is put on and around the stub to prevent vaporized ink from entering into and therefore clogging the vent hole. The cover is also provided at a bottom surface with a plurality of spaced transverse compressing ribs which alternately extend from two longer sides of the cover to end at points a distance exceeded a longitudinal centerline of the cover, such that a wound air path is defined below the cover by the staggered compressing ribs. This wound air path below the cover replaces the zigzag venting slot that is otherwise provided on the cover of the conventional ink cartridge, enabling the ink cartridge of the present invention to be more easily produced at reduced bad yield. Air entering into the case via the vent hole can evenly and smoothly flow throughout the case via the wound air path above the ink absorbent to ensure even and smooth supply of ink to an ink-dispensing outlet of the ink cartridge.

For the ink cartridge of the present invention to be structural strong, the case and the cover are integrally made of hard resin material by injection molding and are provided with reinforcing ribs at proper positions.

And, for the ink cartridge of the present invention to have an extended usable life, a capped ink-refilling hole is provided on the cover.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
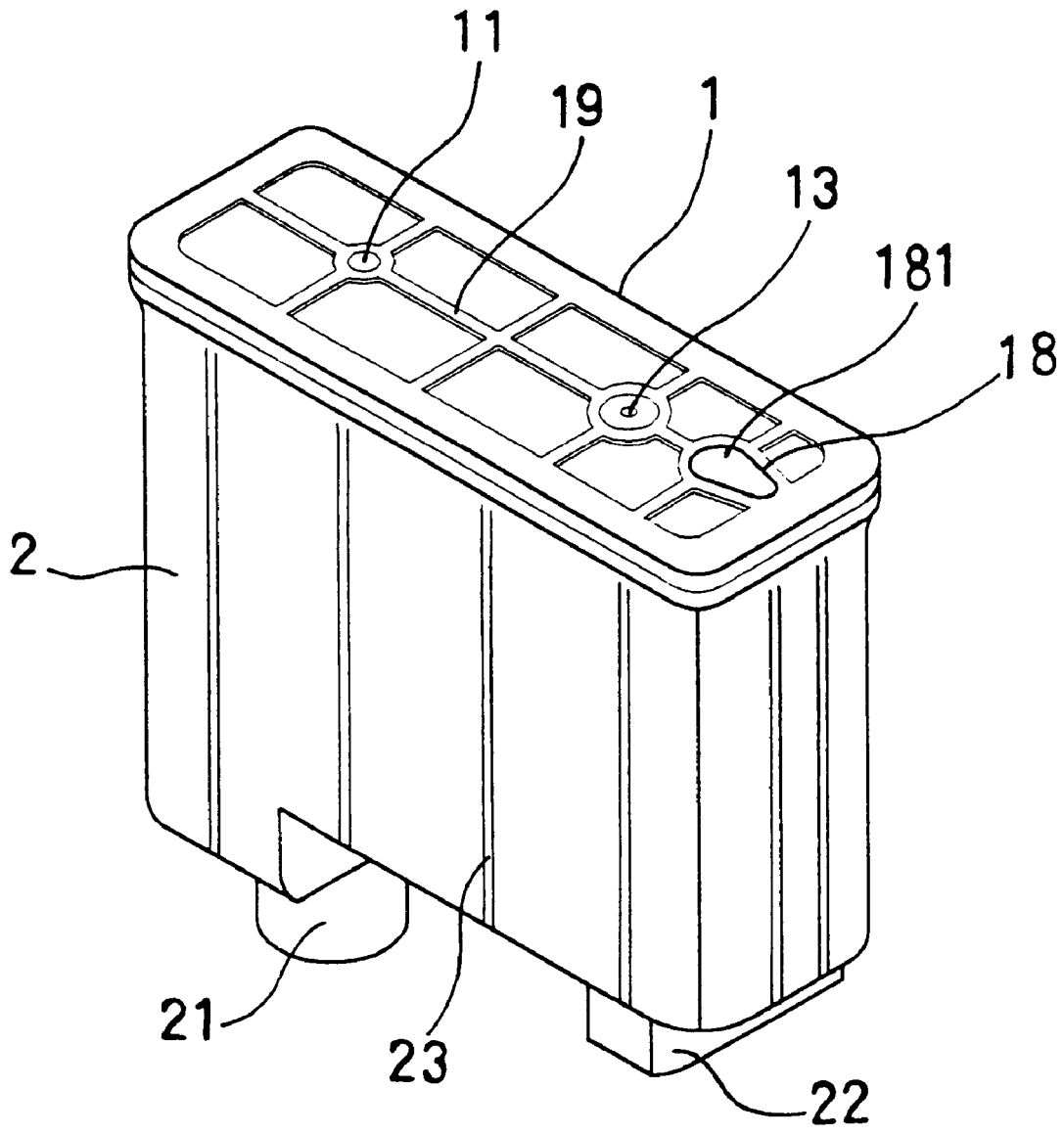
FIG. 1 is a perspective of an ink cartridge according to the present invention.
Figure 2:
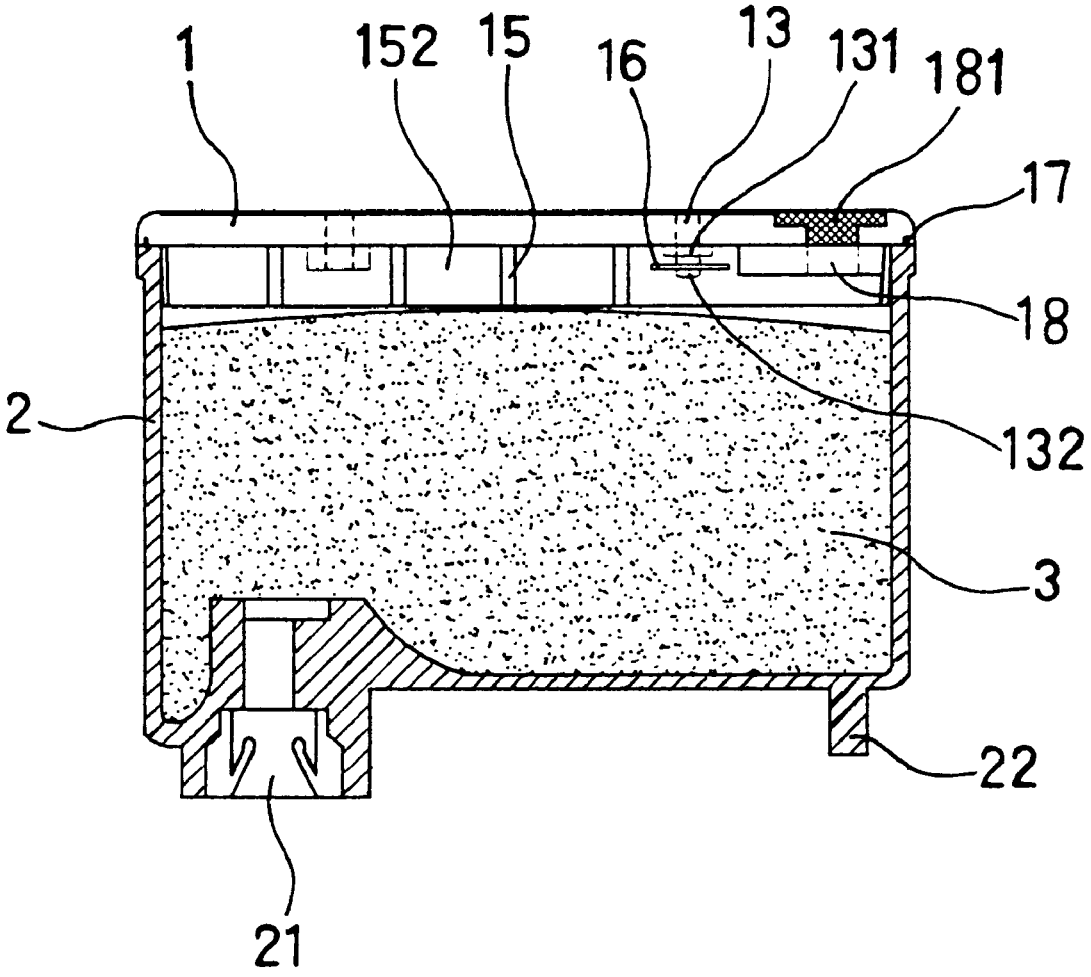
FIG. 2 is a sectional view of the ink cartridge of FIG. 1 in an assembled state.

Please refer to FIGS. 1 and 2 that are perspective and sectional views, respectively, of an ink cartridge according to the present invention. As shown, the ink cartridge of the present invention mainly includes a cover 1, a case 2, and an ink absorbent 3 disposed in the case 2.

Figures 3A, 3B:
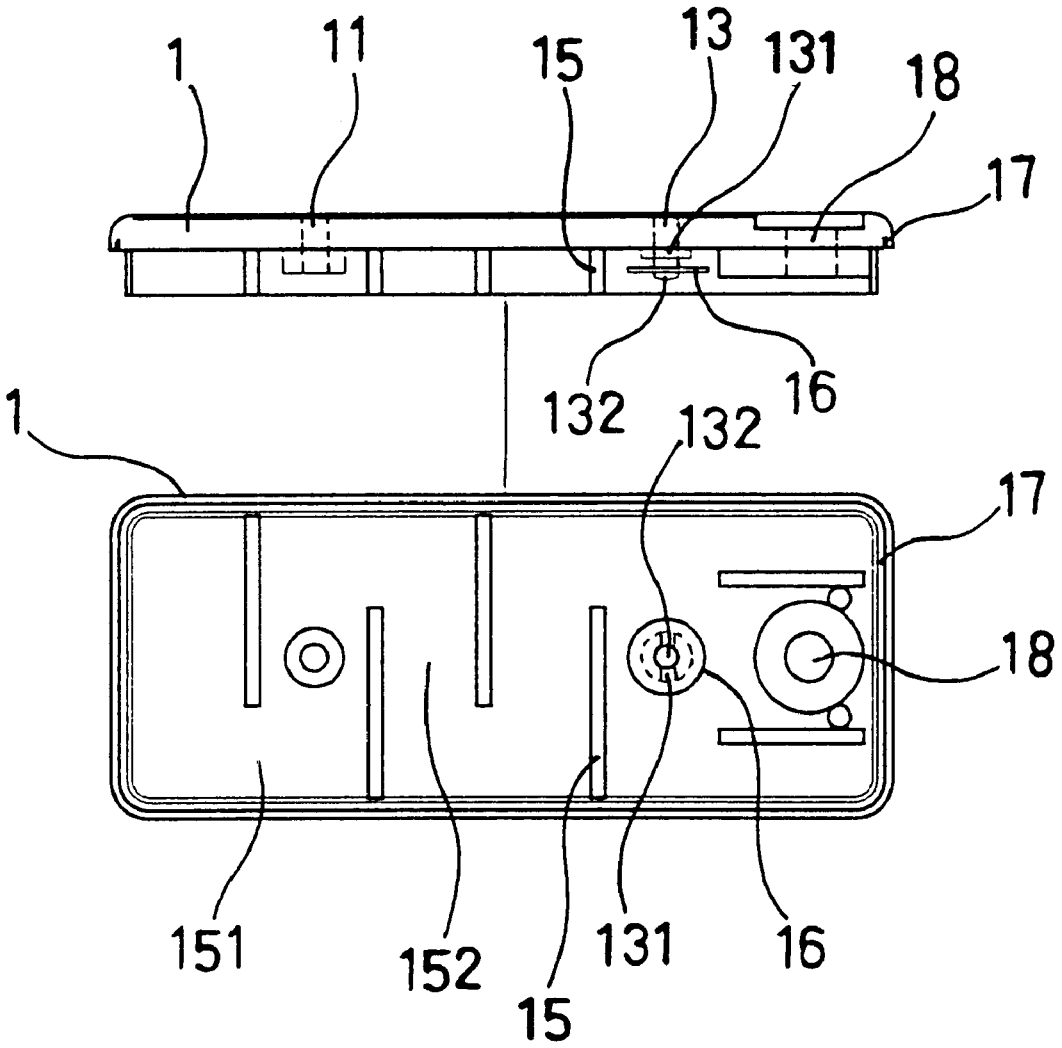
FIG. 3 includes a front plan view and a bottom plan view of a cover of the ink cartridge of FIG. 1.

Please also refer to FIG. 3 in which a front plan view and a bottom plan view of the cover 1 of the ink cartridge of the present invention are shown. The cover 1 is provided at a top with at least an ink-filling hole 11 and a vent hole 13. The vent hole 13 extends down into the case 2 with an annular wall formed at a bottom surface of the cover 1 around a lower end of the vent hole 13. Two diametrically opposite air passages 131 are formed on the annular wall to communicate the vent hole 13 with interior of the case. A lower end of the vent hole 13 downward projects from the annular wall to form a solid and sealed stub 132. A stop disc 16 made of a soft plastic material and having a central through hole is fixedly mounted on and around the stub 132 to prevent vaporized ink in the case 2 from entering into the vent hole 13 to clog the same. The cover 1 is provided at a bottom surface with a plurality of transverse pressing ribs 15. These pressing ribs 15 are spaced from one another and alternately extend from two longer sides of the cover 1 to end at points a distance exceeded a longitudinal centerline of the cover 1, such that a space 151 is left between an end of each pressing rib 15 and one longer side of the cover 1 opposite to that pressing rib 15. With this arrangement, a wound air path 152 is defined below the cover 1 by these staggered pressing ribs 15. The cover 1 is also formed at the bottom surface along and close to an outer periphery thereof with a continuous groove 17 for absorbing any compressing deformation of the cover 1 when the same is covered onto the case 2. An ink-refilling hole 18 with a replaceable cap 181 is also provided on the cover 1. The ink absorbent 3 in the case 2 may be refilled with new and good ink via the ink-refilling hole 18 by removing the cap 181. After refilling, the cap 181 is replaced to close the ink-refilling hole 18. With this arrangement, the ink cartridge of the present invention may have an extended usable life.

The case 2 defines an inner space for receiving the ink absorbent 3 therein and is adapted to fitly connect at upper edges to the cover 1. The case 2 has a stepped bottom that includes a downward projected portion at where an ink-dispensing outlet 21 is provided, and a flat portion.

A supporting leg 22 downward extends from an outer side of the flat portion opposite to the projected portion.

Figure 4:
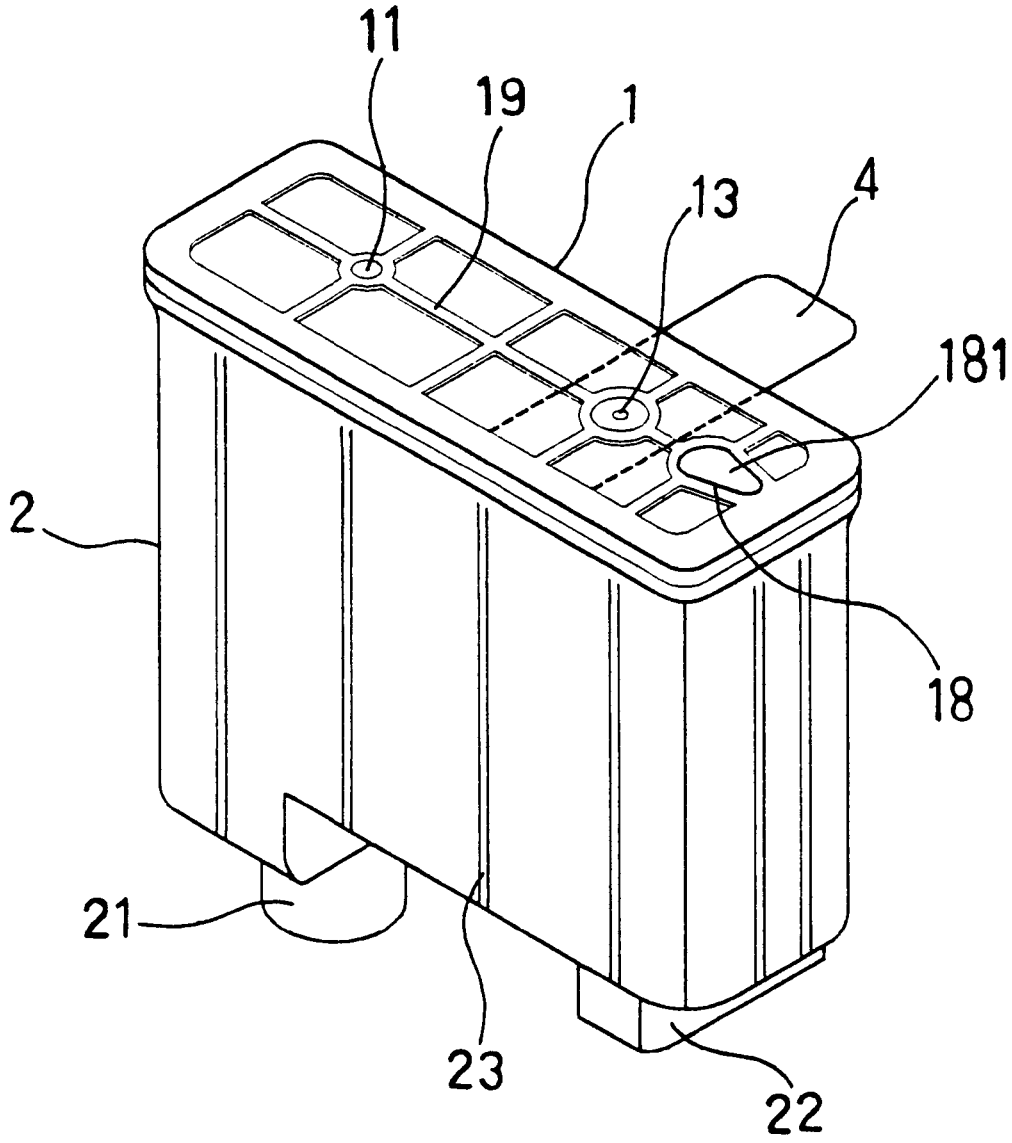
FIG. 4 shows a finished product of the ink cartridge of the present invention, wherein a vent hole thereof is closed with a releasable film.

The cover 1 and the case 2 can be connected to each other by means of ultrasonic welding along a joint of the cover 1 and the case 2 to form a unitary body as shown in FIGS. 2 and 4. When the cover 1 is assembled to the case 2, the pressing ribs 15 provided at the bottom surface of the cover 1 suitably press against and thereby confine the ink absorbent 3 in the case 2. A small piece of plastic film 4 in predetermined dimensions is removably attached to and thereby closes an upper end of the vent hole 13 at the top of the cover 1 when the cover 1 is connected to the case 2 by ultrasonic welding to form a finished product of the ink cartridge of the present invention.

Figure 5:
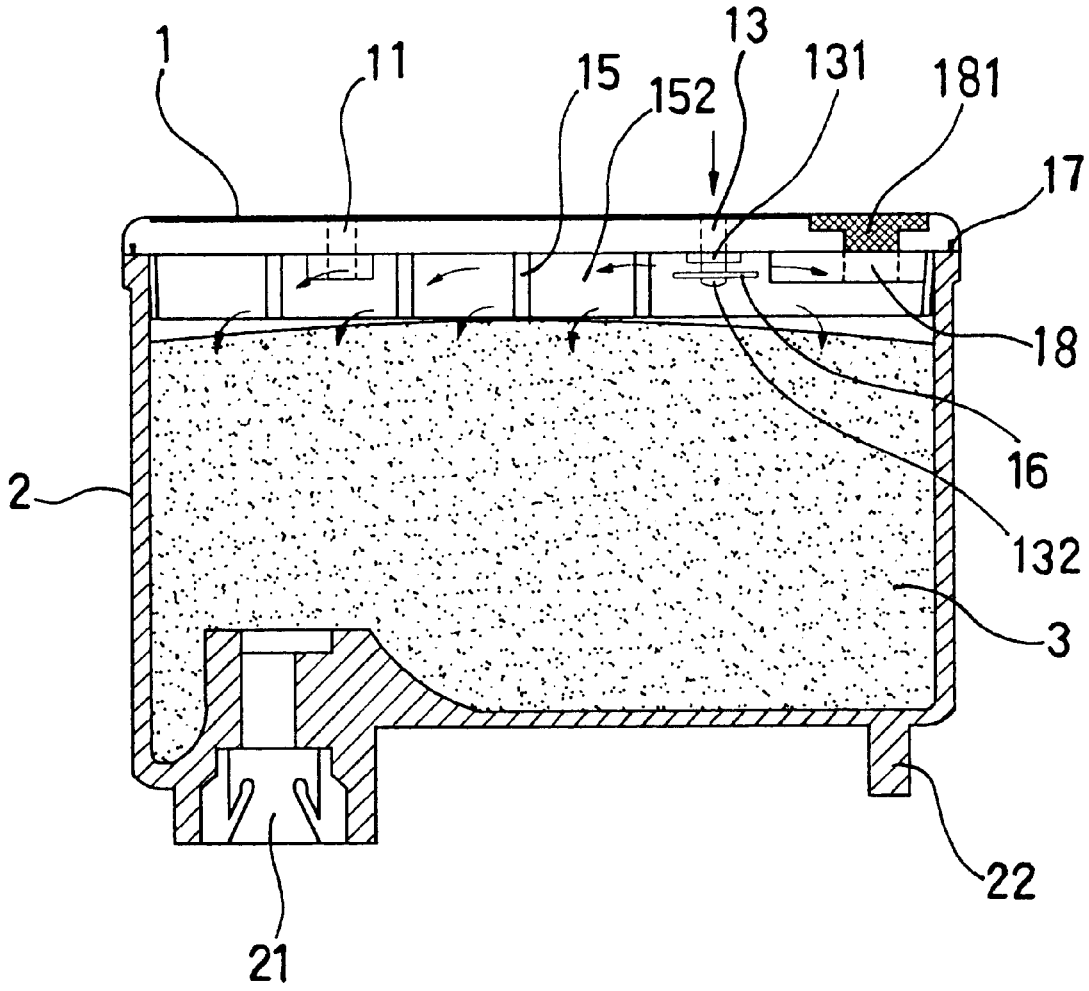
FIG. 5 is a sectional view of the ink cartridge of the present invention in use.

Please now refer to FIG. 5. When the plastic film 4 is removed from the upper end of the vent hole 13, air is admitted into the ink cartridge via the vent hole 13 and the two air passages 131. Air passing through the air passages 131 flows along the wound air path 152 defined by the staggered pressing ribs 15 and the spaces 151, generating a uniform air pressure on the ink absorbent 3 in the case 2 and therefore enabling the ink absorbent 3 to evenly and smoothly supply ink to the ink-dispensing outlet 21. The stop disc 16 mounted around the lower end of the vent hole 13 prevents vaporized ink from entering into and clogging the air passages 131 and the vent hole 13 and is therefore helpful in the supply of air into the ink cartridge and the even and smooth supply of the ink via the ink-dispensing outlet 21.

Figure 6:
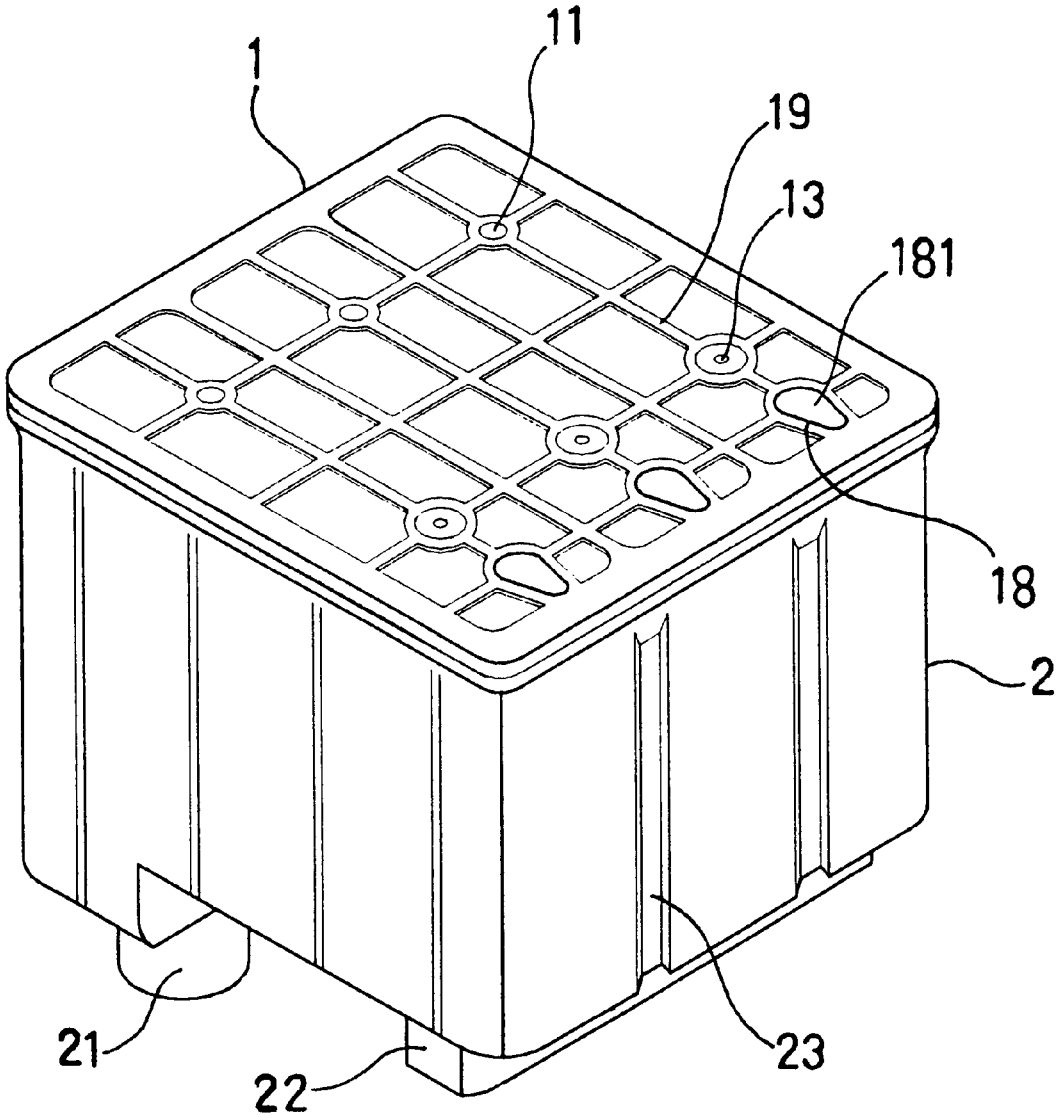
FIG. 6 is a perspective of a multi-color ink cartridge according to the present invention.

The ink cartridge of the present invention shown in FIG. 1 is designed for containing only one color of ink. However, it is understood that the ink cartridge of the present invention may also be designed to contain more than one color of ink. For example, FIG. 6 shows another ink cartridge according to the present invention that can be used to contain three colors of ink. In the case of FIG. 6, the cover 1 of the ink cartridge is provided with ink-filling holes 11, vents holes 13, and ink-refilling holes 18 respectively in the number corresponding to the number of colors of the ink to be contained in the ink cartridge.

Both the cover 1 and the case 2 of the ink cartridge of the present invention are integrally injection molded from a hard resin material. For the cover 1 and the case 2 to be structurally strong to effectively prevent deformation after the injection molding, raised and checkered ribs 19 are formed on the top of the cover 1 as reinforcement, and vertically extended reinforcing recesses 23 are spaced along side walls of the case 2. With the above arrangements, the ink cartridge of the present invention could be more easily produced at largely reduced bad yield and accordingly effectively increased productivity. Moreover, the ink cartridge of the present invention has extended usable life and is environmental friendly because it has reinforced structure and the ink absorbent can be refilled with ink without the need of frequently discarding the whole ink cartridge.

It is apparent that the present invention is illustrated with the description of a preferred embodiment thereof, and it is understood that many changes and modifications in the described embodiment can be carried out without departing from the scope of the invention which is intended to be limited only by the appended claims.

What is claimed is:

1. An ink cartridge comprising a case, an ink absorbent received in said case, and a cover connected to upper edges of said case by ultrasonic welding;

said cover being provided at a top with an ink-filling hole and a vent hole, said vent hole extending down into said case with an annular wall formed at a bottom surface of said cover around a lower end of said vent hole, said lower end of said vent hole downward projecting from said annular wall to form a solid and sealed stub, on and around which a stop disc is fixedly mounted to prevent vaporized ink in said case from entering into said vent hole; and said bottom surface of said cover being provided with a plurality of transverse pressing ribs, said pressing ribs being spaced from one another and alternately extending from two longer sides of said cover to end at points a distance exceeded a longitudinal center line of said cover, such that a space is left between an end of each said pressing ribs and one longer side of said cover opposite to that pressing rib, such that a wound air path is defined below said cover by said pressing ribs for air entering into said case via said vent hole to evenly and smoothly flow throughout said case via said wound air path above said ink absorbent; and said case having a stepped bottom which includes a downward projected portion, at where an ink dispensing outlet is provided, and a flat portion from an outer side thereof opposite to said projected portion, a supporting leg downward extends, and wherein aid annular wall formed at said bottom surface of said cover around said lower end of said vent hole is provided with two diametrically opposite air passages to communicate said vent hole with an internal space of said case for air to flow into said case via said vent hole and said two air passages, and wherein said stop disc disposed around said stub extended from said lower end of said vent hole is made of a soft plastic material and has a central through hole through which said stub extends and thereby associates with said stop disc.

* * * * *